US005379023A

United States Patent [19]

Dalton

[11] Patent Number: 5,379,023

[45] Date of Patent: Jan. 3, 1995

[54] ALARM SYSTEM

[75] Inventor: Paul W. Dalton, Coventry, England

[73] Assignee: Volumatic Limited, Coventry, England

[21] Appl. No.: 958,925

[22] Filed: Oct. 9, 1992

[30] Foreign Application Priority Data

Oct. 12, 1991 [GB] United Kingdom ..... 9121684

[51] Int. Cl.[6] ..... G08B 13/14

[52] U.S. Cl. ..... 340/568; 340/524

[58] Field of Search ..... 340/568, 524

[56] References Cited

U.S. PATENT DOCUMENTS

| | | | |
|---|---|---|---|
| 3,972,039 | 7/1976 | Marshall | 340/572 |
| 4,616,113 | 10/1986 | Jank et al. | 340/568 |
| 5,066,942 | 11/1991 | Matsuo | 340/568 |
| 5,172,098 | 12/1992 | Leyden et al. | 340/568 |

FOREIGN PATENT DOCUMENTS 2658639 8/1991 France .

*Primary Examiner*—Glen Swann

*Attorney, Agent, or Firm*—Ware, Fressola, Van der Sluys & Adolphson

[57] ABSTRACT

A strip (12) provides a plurality of alarm stations (16, 20) each associated with an article sensor (24) such as a microswitch. Each station (16, 20) functions independently of the others to activate a remote alarm unit (18) and has its own indicator light (50), to indicate which alarm station (16, 20) has been triggered. Resetting by a shorting plug at the alarm station (16, 20) illuminates a resetting indicator light (53) and the sensor (24) is then resettable during a short time period for which only the alarm station being reset is inoperative. All remaining alarm stations are fully operational throughout alarm and resetting at one alarm station.

6 Claims, 2 Drawing Sheets

ALARM SYSTEM

TECHNICAL FIELD

The present invention relates to an alarm system.

BACKGROUND OF THE INVENTION

Currently, the type of alarms which are in use in shops and stores to protect products on display are loop alarm systems. In such a system a cable runs from a central alarm unit along the product shelves and back to the alarm unit. Each product is connected to the loop in some manner and there are a number of break points in the loop to enable products to be removed or attached to the loop. If any one break point is disconnected then the alarm sounds and is normally switched off using a keyswitch, thus disabling the whole system. It is then necessary to check each break point in turn and perhaps the whole loop in order to find out which break point has been disconnected.

DISCLOSURE OF INVENTION

The present invention seeks to provide an improved alarm system.

According to the invention there is provided an alarm system for protecting products on display in a shop or store, the alarm system comprising:

alarm unit having an alarm;

a plurality of alarm stations, each associated with a product, each alarm station having:

an alarm output means connected to said alarm unit;

sensor means associated with the alarm station adapted to sense the presence of said product;

indicator means at the alarm station;

wherein each alarm station is independent of the other alarm stations of the system and, on receipt of a preselected signal from the sensor means, produces an alarm signal at said alarm output means to activate the alarm, and also operate said indicator means.

Viewed from another aspect, the present invention provides an alarm system for protecting products on display in a shop or store, the alarm system comprising:

an alarm unit;

a plurality of alarm stations connected to said alarm unit;

sensor means associated with each said alarm station for sensing the presence of a product, each said alarm station having input means for connection to a respective sensing means;

and wherein each alarm station is independently operable in response to receipt of a preselected signal from the associated sensor means to activate an alarm of said system, and to reset said alarm in response to a preselected input condition.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
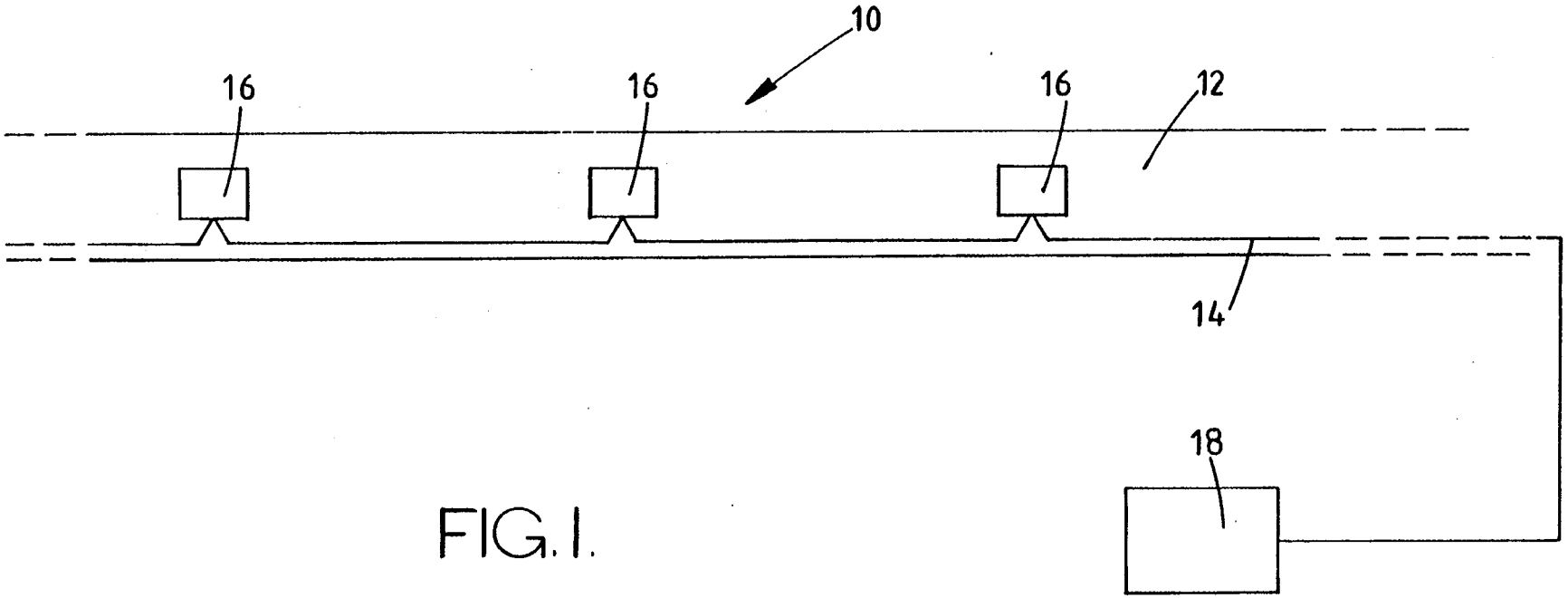
FIG. 1 is a schematic diagram of an embodiment of an alarm system according to the present invention.

FIG. 1 is a schematic diagram of an alarm system 10, according to the invention for use in shops and stores for protecting products such as hi-fi equipment and televisions, on display.

The system has a connector strip 12 through which runs cabling 14 connecting a number of alarm station sockets 16 with a separate alarm unit 18 for sounding an alarm originating from any one of the alarm stations. The connector strip 12 may be rigidly secured to or formed as part of shelving in the shop or store, or may be in the form of a flexible strip. The strip 12 may be provided with connections at each end to enable several such strips to be interconnected to extend the alarm system over a wider area.

Figure 2:
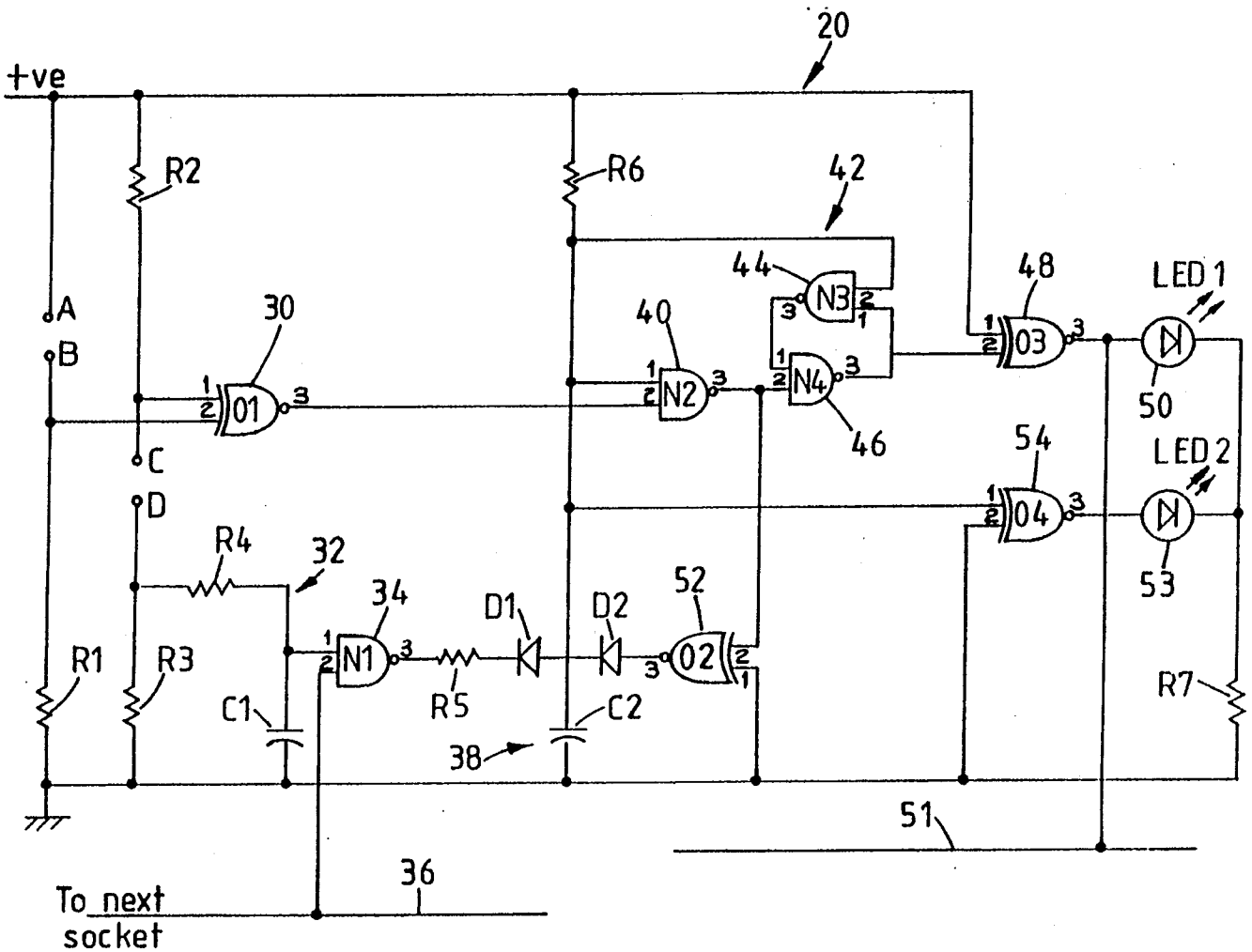
FIG. 2 is a circuit diagram of a portion of the system of FIG. 1.
Figure 2A:
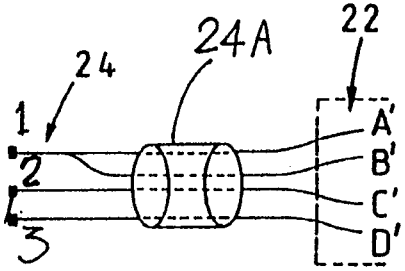
FIG. 2A is a diagrammatic representation of a clip used in the alarm system.

Each socket 16 is a four-terminal socket having terminals A, B, C and D which are connected in an associated switching circuit 20, shown in FIG. 2. The switching circuit may be co-located with the associated socket. For example, the associated socket may be integral thereto or may be located adjacent the associated switching circuit.

Each product to be protected is physically attached to a microswitch 24 in such a manner that movement or removal of the product from a shelf trips the microswitch. This can be achieved with a simple pressure microswitch on which a product such as a television set is stood. On products such as clothing, for example, the microswitch can be in the form of a clip 24A which has to be opened for removal of the garment, opening of the clip tripping the microswitch.

The microswitch is connected to a plug 22 having terminals, A', B', C', and D' which can be plugged into the socket 16. The microswitch is a single pole changeover switch with terminals 1, 2 and 3, terminal 1 being connected to both terminals A' and B' of the plug 22 and terminals 2 and 3 being connected respectively to terminals C' and D' of the plug 22.

The circuit 20 has an EXCLUSIVE NOR gate 30 a first input of which is connected to terminal C of the socket 16 and a second input of which is connected to terminal B. Terminal D is connected to earth through a resistance R3 and also through resistance, capacitance chain R4, C1, the junction of which is connected to a first input of a NAND gate 34. A second input of the NAND gate 34 is connected to a bus line 36 which is connected to corresponding inputs of gates of each corresponding circuit at each other socket 16 and to the alarm unit 18 via cabling 14.

The output of NAND gate 34 is coupled via a resistance R5 and diode D1 to the junction of a resistance capacitance chain R6, C2, and also to a first input of a second NAND gate 40 whose second input is connected to the output of the EXCLUSIVE NOR gate 30.

The output of NAND gate 40 is connected to a SET/RESET latch circuit 42 formed by two NAND gates 44, 46 and whose output is coupled through a further EXCLUSIVE NOR gate 48 to a light emitting diode (LED) 50 and also to a further bus line 51 which connects with the alarm unit 18 via cabling 14.

The output of NAND gate 40 is also connected through an EXCLUSIVE NOR gate 52 and a further diode D2 to the junction of the resistance capacitance chain R6, C2. Finally, this junction is also coupled through EXCLUSIVE NOR gate 54 to a further light emitting diode (LED) 53.

When socket 16 is empty i.e. with no plug 22 being present, the first input of EXCLUSIVE NOR gate 30 is held high whilst the second input is held low, resulting in the output of gate 30 being held low. In use, when the microswitch 24 is attached to an accessory and the plug 22 is plugged into a socket 16, terminals 3 and 2 of the microswitch are interconnected by the microswitch, thus connecting together terminals C and D of the circuit. 20. Terminals A and B of the circuit 20 are also interconnected via the plug 22. The first input of gate 30 is thus pulled low and the second input is pulled high. In this condition, the output of gate 30 is still low. However, if any of the connecting wires between the switch 24 and the plug 22 are cut, or the switch tampered with, or the microswitch 24 tripped, then both inputs of gate 30 would be at the same level, as a result of which the output of gate 30 goes high.

Because capacitance C2 is normally fully charged, the first input of NAND gate 40 is high and the result of the output of gate 30 going high is that the output of NAND gate 40 goes low, setting the SET/RESET latch 42 and lighting the LED 50 via EXCLUSIVE NOR gate 48. This also trips the alarm at the alarm unit warning personnel that a product has been tampered with. The particular socket 16 in question can easily be identified by the lit LED 50 which, for convenience, can be a red LED. There is, therefore, no need to make a detailed check of the alarm system to locate the product that has been tampered with as this will be readily apparent from the lit red LED 50.

The output from NAND gate 40 also causes the output of EXCLUSIVE NOR gate 52 to go high, thus keeping capacitance C2 fully charged and preventing resetting of the circuit which can only happen on discharge of capacitance C2 as is described below.

In order to reset the circuit, and turn off the alarm, it is necessary to remove the cause of the alarm to allow gates 30, 40 and 52 to revert to their non alarm states. The SET/RESET latch 42, however, remains latched to maintain the LED 50 lit to indicate that an alarm has occurred. Once the socket at which the alarm has been triggered is located by authorised personnel a shorting plug in which terminals D′ and A′ are interconnected is inserted into socket 16, shorting terminals A and D together. This charges capacitance C1 through resistance R4 causing the first input of NAND gate 34 to go high after a time determined by the time constant of the resistance capacitance chain R4, C1. If the second input of NAND gate 34 is also high then the output of gate 34 goes low, discharging capacitance C2 via resistance R5 to reset the SET/RESET latch 42 via NAND gate 44. This extinguishes LED 50 and turns off the alarm. At the same time, LED 53 is lit via gate 54. LED 53 is typically green to indicate that the alarm has been cleared. The second input of gate 34 is controlled via the bus line 36 from the alarm unit 18 which holds the input high or low respectively to enable or disable the action of the shorting plug.

If the shorting plug is then removed from socket 16, capacitance C2 charges via resistance R6 and after a time period determined by the time constant of capacitance C2 and resistance R6 LED 53 is extinguished via EXCLUSIVE NOR gate 54. During the reset condition and whilst capacitance C2 is charging (LED 53 is on) the first input of NAND gate 40 is held low, inhibiting the gate from generating an alarm condition. This short time period allows the plug 22 associated with the microswitch 24 to be reconnected after the microswitch has been reset, once the problem which triggered the alarm has been resolved.

The benefits of the above described system are that the main alarm is never turned off and need not be accessible. In an alarm situation attention is drawn to the particular alarm station and not a central point where the main alarm is located. Because the main alarm need never be switched off the system is not vulnerable during resetting of the alarm.

Although the invention has been shown an described with respect to a best mode embodiment thereof, it should be understood by those skilled in the art that the foregoing and various other changes, omissions and additions in the form and detail thereof may be made therein without departing from the spirit and scope of the invention.

I claim:

1. An alarm system protecting products on display in a shop or store, the alarm system comprising:

an alarm unit having an alarm; and a plurality of alarm stations, each associated with a respective product, each alarm station being independent of other alarm stations in the system, each alarm station having indication means at the respective product for providing a reset indication signal such as a visual indication when an associated alarm station is in a reset mode and for providing an alarm indication signal such as an audio or visual alarm when the associated alarm station is in an alarm mode, sensor means associated with each alarm station, for sensing the presence of said product and for providing an alarm signal to the alarm at the alarm unit and to said indication means for switching it from the reset mode to the alarm mode, and reset means for selectively negating the alarm signal to said alarm unit, and for switching said indication means from the alarm mode to the reset mode.

2. An alarm system according to claim 1, wherein, each alarm station also has a timer circuit for disabling the alarm signal to said alarm unit for a short period after operation of the reset means to permit resetting of the sensor means.

3. An alarm system protecting products on display in a shop or store, the alarm system comprising:

an alarm unit having an alarm; and a plurality of alarm stations, each associated with a product, each alarm station having an alarm output means connected to said alarm unit, sensor means associated with the alarm station adapted to sense the presence of said product and to produce a preselected signal, indicator means at the alarm station, each alarm station being independent of the other alarm stations of the system and, on receipt of said preselected signal from the sensor means, producing an alarm signal at said alarm output means to activate the alarm and to operate said indicator means, reset means selectively operable to negate the alarm signal at said alarm output means, for enabling the alarm to deactivate, and for rendering said indicator means at the alarm station inoperative, and for operating a reset indicator means at the alarm station during resetting.

4. An alarm system according to claim 3, wherein said sensor means includes a plug and socket connector associated with the alarm station adapted to sense the presence of said product and to produce the preselected signal.

5. An alarm system according to claim 3, wherein said sensor means includes means which has to be opened for removal of the garment for tripping a microswitch associated with the alarm station adapted to sense the presence of said product and to produce the preselected signal.

6. An alarm system according to claim 3, wherein said sensor means includes a microswitch and a socket connector associated with the alarm station adapted to sense the presence of said product and to produce the preselected signal.

* * * * *

UNITED STATES PATENT AND TRADEMARK OFFICE

CERTIFICATE OF CORRECTION

PATENT NO. : 5,379,023
DATED : January 3, 1995
INVENTOR(S) : P. Dalton

It is certified that error appears in the above-indentified patent and that said Letters Patent is hereby corrected as shown below:

At column 2, line 7, please insert a comma after "invention"; and at line 37, please delete the comma after "terminals".

At column 3, lines 10-11, please delete the period between "circuit" and "20".

Signed and Sealed this

Eighteenth Day of April, 1995

Bruce Lehman

*Attest:*

BRUCE LEHMAN

*Commissioner of Patents and Trademarks*

*Attesting Officer*